US009765776B2

(12) United States Patent
Metz et al.

(10) Patent No.: US 9,765,776 B2
(45) Date of Patent: Sep. 19, 2017

(54) SCREW SPINDLE PUMP

(71) Applicant: LEISTRITZ PUMPEN GMBH, Nürnberg (DE)

(72) Inventors: Jürgen Metz, Feucht (DE); Kris Zemanek, Lauf an der Pegnitz (DE)

(73) Assignee: LEISTRITZ PUMPEN GMBH, Nürnberg (DE)

( * ) Notice: Subject to any disclaimer, the term of this patent is extended or adjusted under 35 U.S.C. 154(b) by 297 days.

(21) Appl. No.: 14/605,403

(22) Filed: Jan. 26, 2015

(65) Prior Publication Data

US 2015/0240810 A1 Aug. 27, 2015

(30) Foreign Application Priority Data

Feb. 25, 2014 (DE) ..... 10 2014 102 390

(51) Int. Cl.

| | |
|---|---|
| ***F01C 1/16*** | (2006.01) |
| ***F01C 1/24*** | (2006.01) |
| ***F03C 2/08*** | (2006.01) |
| ***F04C 2/08*** | (2006.01) |
| ***F04C 18/08*** | (2006.01) |
| ***F01C 1/08*** | (2006.01) |
| ***F04C 3/08*** | (2006.01) |
| ***F04C 2/16*** | (2006.01) |
| ***F01C 21/10*** | (2006.01) |

(52) U.S. Cl.

CPC ..... *F04C 3/085* (2013.01); *F01C 21/108* (2013.01); *F04C 2/16* (2013.01)

(58) Field of Classification Search

CPC ..... F04C 3/085; F04C 2/16; F01C 21/108
USPC ..... 418/232–233, 201.1–201.2, 202, 131, 418/132, 134
See application file for complete search history.

(56) References Cited

U.S. PATENT DOCUMENTS

| | | | | |
|---|---|---|---|---|
| 1,991,541 | A | 2/1935 | Cannizzaro | |
| 2,922,377 | A | 1/1960 | Whitfield | |
| 7,497,672 | B2 * | 3/2009 | Inagaki | F04C 18/16 418/201.1 |
| 2012/0121450 | A1 * | 5/2012 | Eckert | F04C 2/16 418/201.1 |

FOREIGN PATENT DOCUMENTS

| | | | |
|---|---|---|---|
| DE | 4123384 | A1 | 1/1993 |
| DE | 4308755 | A1 | 9/1994 |
| JP | 2003212331 | A | 7/2003 |
| JP | 2009185876 | A | 8/2009 |
| JP | 2013015108 | | 1/2013 |

* cited by examiner

*Primary Examiner* — Deming Wan
(74) *Attorney, Agent, or Firm* — Lucas & Mercanti, LLP

(57) ABSTRACT

A screw spindle pump having a housing hi which a drive spindle and at least one running spindle having profile assemblies which engage inside each other are received, the free end of the drive spindle and the end portion of the running spindle being supported on a plate which is arranged in the housing, the plate having two faces which are inclined in opposing directions relative to each other and which form a V-shape and on which one of the spindles is supported, respectively.

12 Claims, 5 Drawing Sheets

SCREW SPINDLE PUMP

CROSS-REFERENCE TO RELATED APPLICATIONS

The present application claims priority of DE 10 2014 102 390.0, filed Feb. 25, 2014, the priority of this application is hereby claimed and this application is incorporated herein by reference.

BACKGROUND OF THE INVENTION

The invention relates to a screw spindle pump having a housing in which a drive spindle and at least one running spindle having profile assemblies which engage inside each other are received, the free end of the drive spindle and the end portion of the running spindle being supported on a plate which is arranged transversely in the housing.

Screw spindle pumps of this type are used, for example, as fuel pumps. DE 41 23 384 A1 discloses a fuel conveying unit having a housing in which an electric motor is arranged. The shaft of the electric motor is connected to a drive spindle in a rotationally secure manner, but the transmission of force of the motor to the drive spindle can also be introduced by means of a coupling element (see DE 43 08 755 A1). As a result of the rotation of the motor or the drive spindle, the running spindle is caused to rotate, As a result of the profile assemblies which are also referred to as conveying profiles and which are provided on the drive spindle and the running spindle(s), there are formed together with the housing displacement chambers through which a conveyed fluid is conveyed axially from the intake side to the pressure side. In the screw spindle pump known from DE 41 23 384 A1, the free end of the drive spindle and the end portion of the running spindle are axially supported on a plate which is referred to therein as a bearing face. The fluid conveyed flows past the bearing face at both sides.

Although this fuel pump has been found to be advantageous for many decades, it has been found that, under specific conditions, depending on component tolerances and pressure relationships, an undesirable movement of the spindles may occur. This movement is undefined or irregular; it primarily involves crossing of the spindles. This crossing results in the longitudinal axes of the at least two spindles not being arranged in a precisely parallel manner but instead forming an angle with each other, Therefore, the longitudinal axes of the at least two spindles can also be displaced or crossed with respect to a notional plane in which both longitudinal axes are ideally located, one spindle protruding from one side of the notional plane and the other spindle from the opposing side of the notional plane. This spindle movement which may be observed leads to disadvantageous effects. On the one hand, the profile gaps increase, primarily at the intake side of the screw spindle pump, whereby the leakage of the pump increases. This occurs in particular at elevated medium temperatures, which leads to impaired heat conveying behaviour. The increase of the profile gaps also leads, on the other hand, to a reduction of the degree of efficiency. In addition, the undefined movement of the spindles brings about increased suction pulsation which is also undesirable. The rolling line formed between the two or more spindles is influenced in a negative manner by friction effects, whereby the drive torque which has to be applied by the electric motor is increased. Furthermore, the undesirable wobble movement of the spindles also leads to increased wear.

FIG. 1 shows a plate I of a conventional screw spindle pump, The plate 1 is in the form of a feather key and has a planar upper side 2, The two arrows 3, 4 symbolically represent the longitudinal axes of a drive spindle and a running spindle. In FIG. 1, it can be seen that the two spindles carry out a wobble movement at the upper side 2, that is to say, the ends of the spindles "travel" which results in an oblique position which can be seen particularly well in FIGS. 2 and 3. In FIG. 2, it can be seen that the spindles starting from a parallel starting position at the intake side of the screw spindle pump, at the upper side 2 of the plate 1, have moved apart. FIG. 3 is a view of FIG. 2 rotated through 90° and it can be seen here that the spindles have also moved in a non-uniform manner relative to a notional plane in which ideally parallel spindle axes are located so that the spindle 4 is located in front of this notional plane and the other spindle 3 is located behind this notional plane.

SUMMARY OF THE INVENTION

An object of the invention is therefore to provide a screw spindle pump in which no wobble movement of the spindles occurs.

In order to achieve this object, in a screw spindle pump of the type mentioned in the introduction, there is provision according to the invention for the plate to have two faces which are inclined in opposing directions relative to each other and which form a V-shape and on which one of the spindles is supported, respectively.

The inclination of the faces provided according to the invention counteracts a crossing of the spindles. A highly precisely parallel orientation of the spindles is thus ensured, whereby the problems described are prevented. The inclined faces result in the end portions of the at least two spindles always being subjected to a force which is directed toward the other, whereby a wobble movement which occurs with conventional spindle screw pumps is prevented. At the end portion of the spindles, consequently, at least a small force acts in the transverse direction, whereby the spindles are retained at the ideal position, With the screw spindle pump according to the invention, it is particularly preferable for the inclination of the faces to be selected in such a manner that the spindles are arranged parallel with each other during operation of the screw spindle pump. As a result of this parallel positioning, there is produced an optimum rolling line between the spindles, whereby the drive torque required is reduced.

A particularly advantageous embodiment of the invention makes provision for the inclination angle between the inclined faces and the plate to be between 2° and 30°, a range between 2° and 12° being preferred. As already mentioned, the faces are inclined with respect to each other in such a manner that the spindles are subjected to a force component, which presses or moves the spindles against each other. If the plate with the two faces which are inclined in opposing directions with respect to each other is viewed from the side, it has a V-shape.

According to the invention, it is particularly preferred for both inclined faces to have the same angle of inclination. The angle of inclination is in this instance determined taking into account the medium to be conveyed and other parameters, such as pressure, rotation speed and viscosity, in such a manner that the spindles during operation are positioned parallel with each other and perpendicularly relative to the plate.

There are thereby produced a whole series of positive effects on the screw spindle pump according to the invention. The optimum orientation of the drive spindle and the running spindle leads to a reduction of the leakage. The degree of efficiency increases compared with conventional screw spindle pumps. Furthermore, the undesirable suction pulsation decreases. Another positive effect is the improved heat conveying behaviour of the pump.

In the screw spindle pump according to the invention, it is preferable for both inclined faces to have the same angle of inclination.

It has been found to be quite particularly advantageous for the first inclined face to be inclined with respect to a longitudinal side of the plate and the second inclined face to be inclined with respect to the opposing longitudinal side of the plate. Consequently, each face is inclined twice, on the one hand, the two faces are inclined with respect to each other in opposing directions so that the V-shape is produced and, in addition, each face is inclined with respect to a longitudinal side of the plate, the two faces being inclined in opposing directions. The reason for this is the consideration that the ends of the spindles have two degrees of freedom since they can move on the upper side of the plate. As a result of the dual inclination of the two faces as provided for according to the invention, the wobble movement or crossing of the spindles which would otherwise occur can be practically completely prevented.

The mentioned inclination with respect to a longitudinal side of the plate may be from 2° to 30°, and it is preferably between 2° and 12°. With the screw spindle pump according to the invention, it is preferable for the inclination of the faces forming the V-shape to be of the same magnitude as the inclination of the two faces with respect to a longitudinal side. However, there are also conceivable embodiments in which the V-shaped inclination has a different angle of inclination from the inclination with respect to the longitudinal side.

For technical production reasons, there may be provision for a groove to be provided between the two inclined faces. As a result of the provision of this groove, the production of the plate with the inclined faces is simplified since each inclined face can then be produced by means of a milling method.

It is also within the context of the invention for the free end of the drive spindle and/or the end portion of the running spindle to have a tapered tip whose angle of taper is smaller than the inclination angle between the inclined faces and the plate. It is thereby ensured that the ends of the spindles can always move on the plate, In the context of the invention, there may be provision for the plate to be constructed as a feather key. Optionally, a standard feather key may be provided with the inclined faces by means of a milling method.

The screw spindle pump according to the invention may also be constructed in such a manner that it has a drive spindle and two running spindles which are arranged at opposing sides. With such a configuration, correspondingly inclined faces are provided at least for the two running spindles.

The various features of novelty which characterize the invention are pointed out with particularity in the claims annexed to and forming a part of the disclosure. For a better understanding of the invention, its operating advantages, specific objects attained by its use, reference should be had to the drawings and descriptive matter in which there are illustrated and described preferred embodiments of the invention.

DETAILED DESCRIPTION OF THE INVENTION

Figure 4:
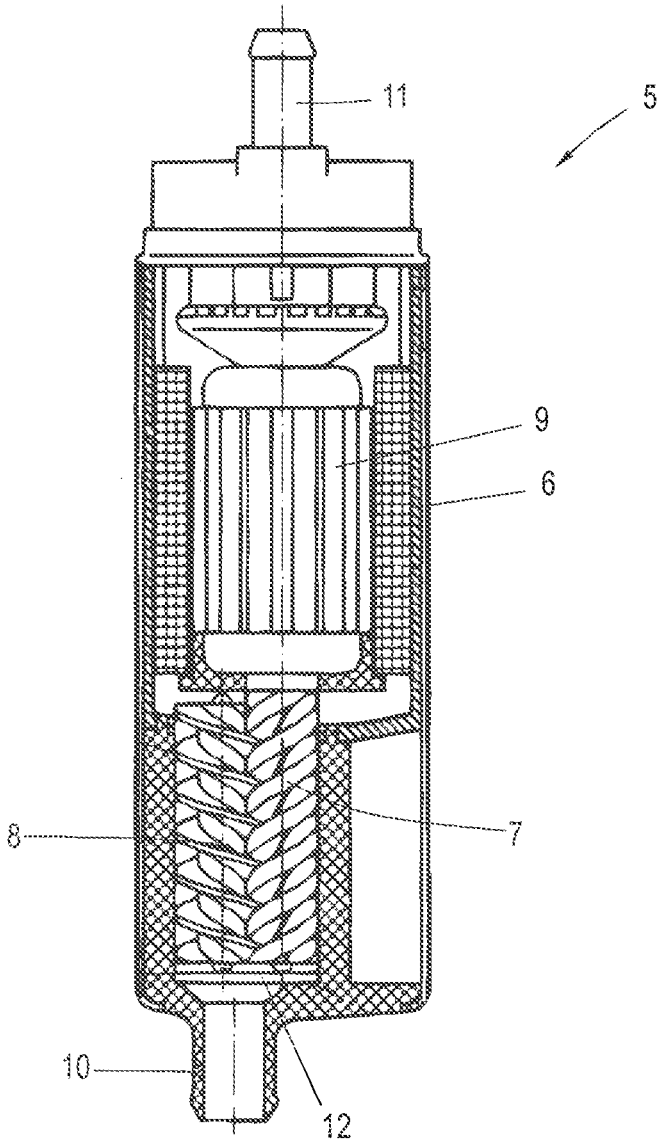
FIG. 4 is a sectioned side view of a screw spindle pump according to the invention.

FIG. 4 shows the significant components of a screw spindle pump 5, comprising a housing 6, in which a drive spindle 7 and a running spindle 8 are received. Both spindles have profile assemblies which mesh with each other. An electric motor 9 drives the drive spindle 7; by means of the opposing rotation of the two spindles 7, 8, a fluid, for example, a fuel for a combustion engine, is drawn through an intake nozzle 10. The fluid flows through the electric motor 9 and leaves the housing 6 via an outlet 11.

The free end of the drive spindle 7 and the end portion of the running spindle 8 are supported on a plate 12 which is arranged in the housing 6 transversely relative to the spindles. At both sides of the plate 12, there is provided a free space which is delimited by the housing 6 so that the fluid can flow in through these free spaces.

Figure 1:
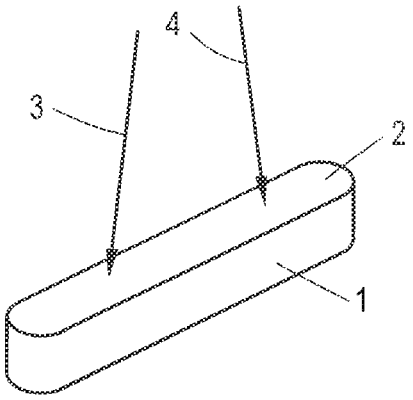
FIG. 1 is a perspective view of a plate of a conventional screw spindle pump.
Figure 2:
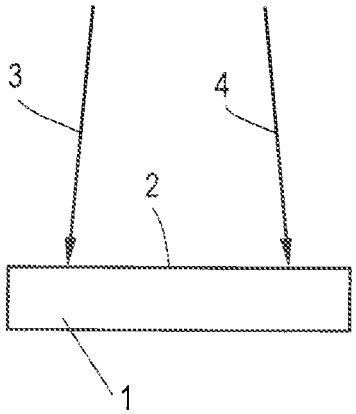
FIG. 2 is a side view of the plate of FIG. 1.
Figure 3:
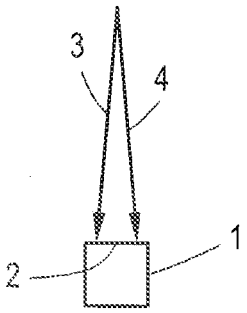
FIG. 3 is a front view of the plate shown in FIG. 1.
Figure 5:
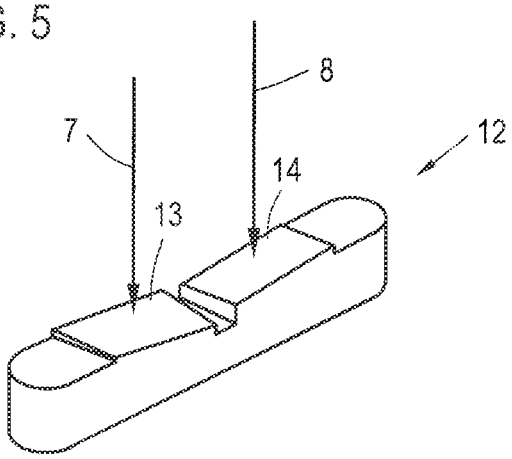
FIG. 5 shows a plate of the screw spindle pump shown in FIG. 4.

FIG. 5 is a perspective view of the plate 12. The plate 12 has in a manner corresponding to the plate shown in FIG. 1 the basic shape of a feather key; in contrast to the plate of FIG. 1, the plate 12 has at the upper side thereof two faces 13, 14 which are inclined in opposing directions with respect to each other and on which one of the spindles is supported in each case. The arrows 3, 4 are a symbolic representation of the longitudinal axis of the running spindle and the drive spindle. The inclination of the two faces 13, 14 is selected in such a manner that they intersect along a (notional) line, as can best be seen in the side view of FIG. 6. The two faces 13, 14 are inclined with respect to each other so that they form at least a slight V-shape. For technical production reasons, a transversely extending groove 15 is provided between the two faces 13, 14. The inclination of the two faces 13, 14 which is visible in FIG. 6 counteracts the described crossing of the spindles so that they are retained at the ideal position so that they are arranged in a parallel manner.

Figure 6:
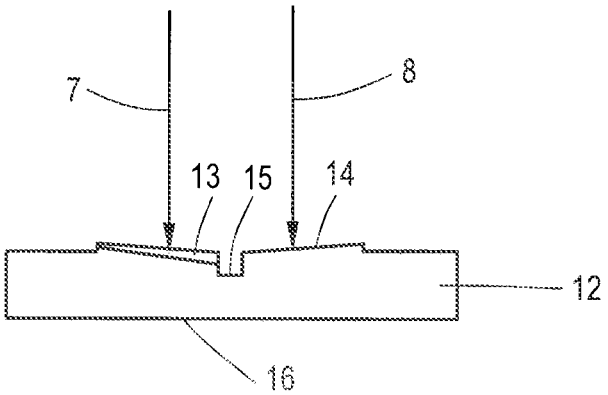
FIG. 6 is a side view of the plate shown in FIG. 5.
Figure 7:
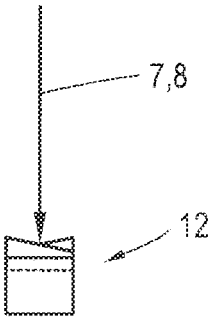
FIG. 7 is a front view of the plate shown in FIG. 5.

FIG. 7 is a view of FIG. 6 rotated through 90° and shows symbolically via the two arrows that the axes of the drive spindle 7 and the running spindle 8 are also precisely parallel in this plane. At the same time, the drive spindle 7 and running spindle 8 are arranged precisely perpendicularly with respect to the transverse direction which corresponds, for example, to the lower side 16 of the plate 12.

In FIG. 5, it can be seen that the two inclined faces 13, 14 are additionally inclined in opposing directions with respect to longitudinal sides of the plate 12. The face 13 is in the view of FIG. 5 inclined in a forward direction, the face 14 in contrast in a backward direction, The combination of the faces 13, 14 which are inclined twice, that is to say, about two axes of rotation, ensures that no crossing of the spindles 7, 8 occurs and that they are retained in a precisely parallel manner at the desired ideal position. The end portions of the two spindles 7, 8 each have an angle of taper which is smaller than the angle of inclination.

Figure 8:
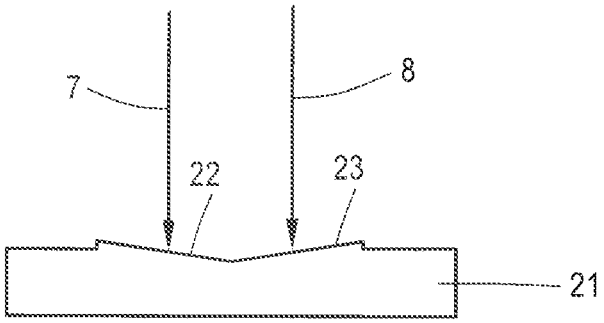
FIG. 8 shows another embodiment of a plate for a screw spindle pump according to the invention.

FIG. 8 shows another embodiment of a plate for a screw spindle pump. The plate 21 has two faces 22, 23 which are inclined in opposing directions with respect to each other and which form a V-shape and on which one of the spindles 7, 8 is supported in each case. In contrast to the embodiment shown in FIGS. 5 to 7, the plate 21 has no groove, The inclined faces 22, 23 are constructed in a symmetrical manner and extend from a centre plane of the plate 21 as far as a raised position which is located further outward, whereby the V-shape is formed. The faces 22, 23 are inclined only about one axis. For technical production reasons, the plate 21 illustrated in FIG. 8 is preferred over the other embodiments.

Figure 9:
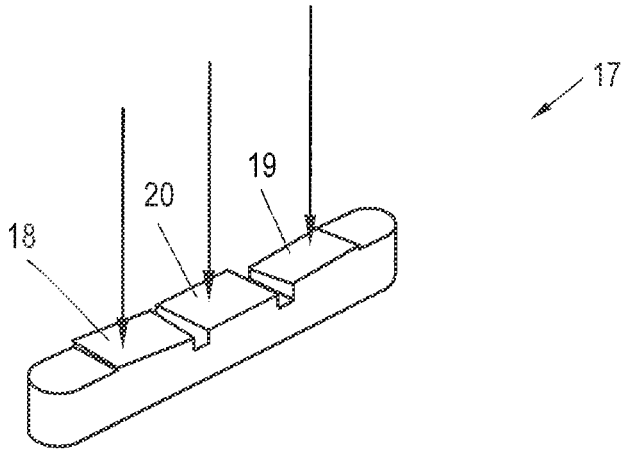
FIG. 9 shows a plate for a screw spindle pump according to the invention with a drive spindle and two running spindles.

FIG. 9 is another embodiment and shows a plate 17 which is provided for a screw spindle pump having a drive spindle and two leading spindles. The two leading spindles are located at opposing sides of the lead spindle. The plate 17 comprises two faces 18, 19 which are inclined in opposing directions with respect to each other and on which the lead spindles are supported. Between them is a planar face 20 on which the drive spindle is supported in an axial manner. The two running spindles, as a result of the inclined faces 18, 19, orientate the drive spindle and are also inclined in opposing directions relative to each other with respect to the notional connection line in a similar manner to the faces 13, 14 of the plate 12.

Figure 10:
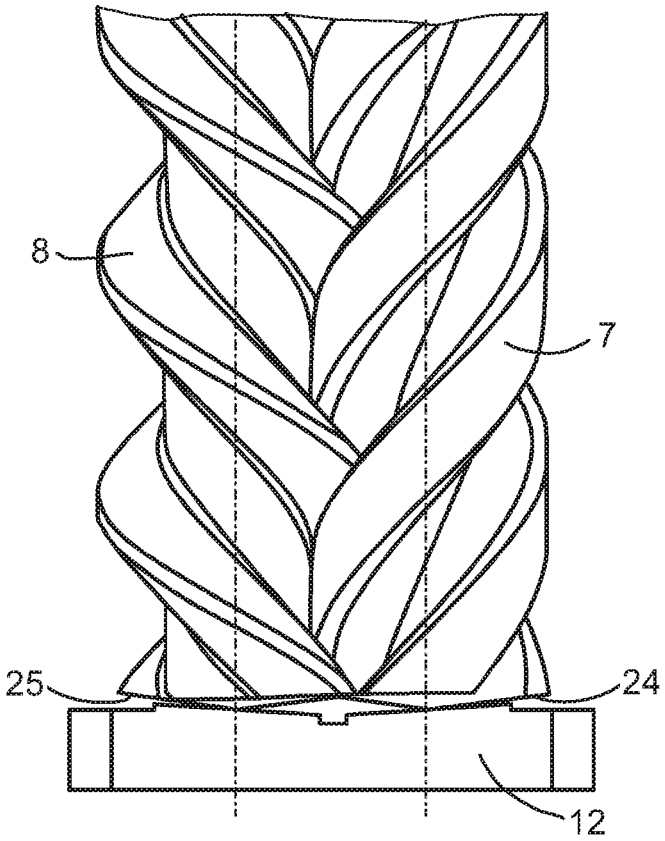
FIG.10 shows an embodiment in which a drive spindle and a running spindle have tapered ends.

FIG. 10 shows an embodiment in which the ends 24, 25 of the drive spindle 7 and the running spindle 8 facing the plate 12 are tapered. The depiction in FIG. 10 is not meant to disclose any specific angles of the tapered ends 24, 25.

While specific embodiments of the invention have been shown and described in detail to illustrate the inventive principles, it will be understood that the invention may be embodied otherwise without departing from such principles.

We claim:

1. A screw spindle pump, comprising:

a housing;

a drive spindle;

a running spindle, the drive spindle and the running spindle being arranged in the housing and having profile assemblies which engage inside each other;

a plate arranged in the housing, the plate having a first side and a second side, the first side facing the drive spindle and the running spindle, and the second side facing away from the drive spindle and the running spindle, a free end of the drive spindle and an end portion of the running spindle being supported on the first side of the plate, wherein the first side of the plate has two faces that are inclined in opposing directions relative to each other and form a V-shape, each of the two faces supports a respective one of the drive spindle and the running spindle.

2. The screw spindle pump according to claim 1, wherein the inclination of the faces is such that the drive spindle and the running spindle are arranged parallel with each other during operation of the screw spindle pump.

3. The screw spindle pump according to claim 1, wherein an inclination angle between each of the faces and the plate is from 2° to 30°.

4. The screw spindle pump according to claim 3, wherein the inclination angle is from 2° to 12°.

5. The screw spindle pump according to claim 3, wherein both of the two faces have a common angle of inclination.

6. The screw spindle pump according to claim 3, wherein at least one of the free end of the drive spindle or the end portion of the running spindle has a tapered tip with an angle of taper smaller than the inclination angle between the inclined faces and the plate.

7. The screw spindle pump according to claim 1, wherein a first of the inclined faces has a lateral inclination with respect to a longitudinal side of the plate and a second of the inclined faces has a lateral inclination with respect to an opposing longitudinal side of the plate.

8. The screw spindle pump according to claim 7, wherein the lateral inclination of the first and the second faces is from 2° to 30°.

9. The screw spindle pump according to claim 8, wherein the lateral inclination is from 2° to 12°.

10. The screw spindle pump according to claim 1, wherein the two inclined faces are spaced apart from each other by a groove.

11. The screw spindle pump according to claim 1, wherein the plate is constructed as a feather key.

12. The screw spindle pump according to claim 1, further comprising a second running spindle, wherein the running spindle and the second running spindle are arranged at opposing sides of the drive spindle.

* * * * *